US005742318A

United States Patent [19]

Miyauchi et al.

[11] Patent Number: 5,742,318

[45] Date of Patent: Apr. 21, 1998

[54] RECORDING APPARATUS

[75] Inventors: Yasuo Miyauchi; Shinji Kanemitsu; Haruo Uchida, all of Yokohama, Japan

[73] Assignee: Canon Kabushiki Kaisha, Tokyo, Japan

[21] Appl. No.: 112,320

[22] Filed: Aug. 27, 1993

Related U.S. Application Data

[63] Continuation of Ser. No. 519,102, May 4, 1990, abandoned.

[30] Foreign Application Priority Data

May 8, 1989 [JP] Japan ..... 1-114530
May 8, 1989 [JP] Japan ..... 1-114531

[51] Int. Cl.[6] ..... B41J 11/00

[52] U.S. Cl. ..... 347/134; 347/104; 271/251; 271/270; 400/615.2; 400/618; 400/636

[58] Field of Search ..... 346/134, 136, 346/140 R; 271/251, 270, 272–274; 400/615.2, 618, 636, 637–639; 347/101, 104, 164, 218, 215, 262; B41J 2/01, 13/00, 13/02, 15/00, 15/04, 15/16

[56] References Cited

U.S. PATENT DOCUMENTS

| | | | |
|---|---|---|---|
| 2,461,376 | 2/1949 | Feldmeier . | |
| 3,954,261 | 5/1976 | Greene et al. | 271/188 |
| 4,419,003 | 12/1983 | Fujie et al. | 271/251 X |
| 4,521,785 | 6/1985 | Matsufuji | 346/134 X |
| 4,601,595 | 7/1986 | Aiba et al. | 400/637 |
| 4,617,580 | 10/1986 | Miyakawa | 346/136 |
| 4,630,815 | 12/1986 | Petersen et al. | 271/273 |
| 4,676,498 | 6/1987 | Kanemitsu et al. | 271/251 |
| 4,681,313 | 7/1987 | Yokoyama et al. | 271/273 |
| 4,723,129 | 2/1988 | Endo et al. | 347/56 |
| 4,834,277 | 5/1989 | Gomoll et al. | 400/605 X |
| 4,862,215 | 8/1989 | Nomura et al. | 355/309 |
| 4,881,831 | 11/1989 | Takita et al. | 400/618 X |
| 4,900,173 | 2/1990 | Okamura | 346/134 X |
| 4,968,164 | 11/1990 | Chevrollier et al. | 400/618 |
| 5,000,439 | 3/1991 | Yoshizawa | 271/274 |

FOREIGN PATENT DOCUMENTS

| | | | |
|---|---|---|---|
| 2617764 | 1/1989 | France . | |
| 3108095 | 10/1982 | Germany . | |
| 57-191080 | 11/1982 | Japan | 400/639 |
| 59-48354 | 3/1984 | Japan . | |
| 60-154089 | 8/1985 | Japan . | |
| 63-21166 | 1/1988 | Japan . | |
| 63-134270 | 6/1988 | Japan | 400/636.1 |
| 1-290460 | 11/1989 | Japan | 400/639 |

*Primary Examiner*—N. Le
*Attorney, Agent, or Firm*—Fitzpatrick, Cella, Harper & Scinto

[57] ABSTRACT

The present invention relates to an image forming system comprising an image forming device for forming an image on a sheet; first feeding rollers arranged at an upstream side of the image forming device, for pinching the sheet and for feeding the sheet to the image forming device; and second feeding rollers arranged at a downstream side of the image forming device, for pinching the sheet and for feeding the sheet at a speed faster than that of the first feeding rollers in order to apply a tension force to the sheet in a transverse direction thereof.

41 Claims, 15 Drawing Sheets

RECORDING APPARATUS

This application is a continuation of application Ser. No. 07/519,102 filed May 4, 1990, now abandoned.

BACKGROUND OF THE INVENTION

1. Field of the Invention

The present invention relates to a recording apparatus and an image forming system which have sheet feeding means for feeding or conveying a sheet.

2. Related Background Art

In a conventional recording apparatus such as a liquid jet recording apparatus including an ink jet head, in order to prevent the floating of a recording medium (sheet) from a platen situated in a printing portion, the rotating speed of the ejector or discharge rollers arranged at a downstream side of the printing portion was slower than the rotating speed of auxiliary scanning rollers arranged at an upstream side of the printing portion. In this way, by applying a moderate tension to the recording medium at the printing portion, the floating of the recording medium (the floating of the sheet) at the printing portion was prevented.

With this arrangement, since the recording medium is forcibly fed by the ejector rollers in contact with the printed surface of the recording medium immediately after the image is recorded on the recording medium, in a recording medium wherein the speed of the fixing of the image on the medium is slow or in a so-called OHP sheet, the printed surface of the recording medium must be introduced into the nip between the ejector rollers after the ink has been fixed, or a method shown in FIG. 20 or FIG. 21 must be used.

FIG. 20 shows a main portion of the conventional recording apparatus, wherein a printing portion or station 3 is constituted by an ink jet head 1, a platen 2 arranged in the vicinity of the head 1 and the like. At an upstream side of the printing portion 3, auxiliary scanning rollers 61, 62 rotated in the direction shown by the arrows are arranged and serve to direct a recording medium P fed along a guide plate 5 to the printing portion 3. The recording medium P output from the printing portion 3 is fed by a pair of ejector rollers 63, 65 arranged at a downstream side of the printing portion 3 and rotated in the direction shown by the arrows. In order to feed the recording medium wherein the speed of the fixing of the image on the medium is slow, a heater 66 for fixing the ink is arranged below the platen 2. The recording medium P is fed by the auxiliary scanning rollers 61, 62 and is subjected to the recording operation at the printing portion 3 by means of the ink jet head 1.

Alternatively, in the conventional recording apparatus, a method shown in FIG. 21 is used. More particularly, the platen 2 is extended at the downstream side of the printing portion 3 to provide a long time sufficient to fix the ink on the recording medium. However, in the above-mentioned conventional example, there arise the following drawbacks.

Firstly, in the method wherein the printed surface of the recording medium P is introduced into the nip between the ejector rollers 63, 65 after the ink is completely fixed on the recording medium, since only after the ink of one line has been fixed on the recording medium the next line can be recorded on the recording medium, it takes a very long time to record one page of the recording medium wherein the speed of the fixing of the image on the medium is slow.

Secondly, in the recording method using the heater as shown in FIG. 20, since the heater for fixing the ink must be additionally provided, the recording apparatus is large-sized and expensive. Thirdly, in the recording method using the platen extension between the printing portion 3 and the ejector rollers 63, 65 as shown in FIG. 21, not only is the recording apparatus large-sized similar to the case of FIG. 20, but also there is a larger blank space or margin at a leading end portion of the recording medium as the distance between the printing portion 3 and the ejector rollers 63, 65 increases, because the recording is started after the leading end of the recording medium has reached the ejector rollers 63, 65.

Further, in a conventional image forming system such as an ink jet printer, wire dot printer and the like, wherein, for example, a sheet is intermittently fed between a platen and a printing means and an image is formed on the sheet by scanning the sheet by means of the printing means, the image was printed on the sheet by scanning the sheet in a transverse direction (of the sheet) by means of the printing means while feeding the sheet intermittently. In such image forming system, the sheet is sometimes frictionally smeared due to the friction between the floating sheet and the printing means. In order to prevent the floating of the sheet, various sheet floating preventing means were arranged in a printing portion or station. For example, as the sheet floating preventing means, a suction device was used for contacting the sheet to the platen surface by absorbing air from the interior of the platen at the printing portion by a pump, or an electrostatic suction device was used for contacting the sheet to the platen by the use of static electricity.

However, contrary to the desire for compactness of the apparatus itself, the above-mentioned image forming system requires not only a considerably large space but also expensive devices such as the suction device and a high voltage power source.

Under the circumstances, as a method for preventing the floating of the sheet at the printing portion by the use of simple means, a sheet feeding mechanism as shown in FIGS. 22 and 23 has been proposed. This sheet feeding mechanism comprises a printing portion 42 including a platen 44 and a printing means (not shown) positioned above the platen, a pair of feed rollers 43 arranged at an upstream side of the platen, and a pair of tension rollers 45 arranged at a downstream side of the platen, and is so designed that a sheet S is tensioned by setting the peripheral speed of the downstream tension rollers 45 to be greater than the peripheral speed of the upstream feed rollers 43. In this way, the sheet S is fed in a direction shown by the arrow 46 while being contacted against the platen 41. With this arrangement, in order to feed the sheet S at a constant speed with high accuracy or to feed the sheet intermittently by a predetermined amount, the sheet holding or nipping force of the paired upstream feed rollers 43 is selected to be greater than the nipping force of the paired downstream tension rollers 45, and the sheet feeding speed of the downstream tension rollers 45 is selected to be greater than the sheet feeding speed of the upstream feed rollers 43.

However, with the conventional arrangement mentioned above, although the floating (slack) of the sheet S in a direction perpendicular to the sheet feeding direction (shown by the arrow 46) could be prevented as shown in FIG. 22, the floating (Sa) of the sheet in a direction parallel to the sheet feeding direction could not be sufficiently prevented as shown in FIG. 23. Therefore, even by using the mechanism wherein the tension rollers 45 are arranged at the downstream side of the printing portion 42, the sheet S was smeared due to the friction between the sheet and the printing means such as an ink jet head.

Further, when the sheet tensioning mechanism comprising the two elongated tension rollers 45 is adopted, since one of the paired tension rollers 45 is pressed against the printed surface of the sheet S immediately after the sheet leaves the printing portion, there arose a problem that an image printed on the sheet was distorted or destroyed if the ink was not fixed to the sheet completely.

SUMMARY OF THE INVENTION

It is an object of the present invention to provide a recording apparatus and an image forming system which can record an image on a sheet effectively.

Another object of the present invention is to provide a recording apparatus which can prevent the smear of a sheet and/or the distortion of an image due to the unfixed ink printed on the sheet.

A further object of the present invention is to provide a recording apparatus which is inexpensive and small-sized.

The other object of the present invention is to provide a recording apparatus having a sheet feeding means for preventing the floating of a sheet from a platen at a printing portion.

DETAILED DESCRIPTION OF THE PREFERRED EMBODIMENTS

Figure 1:
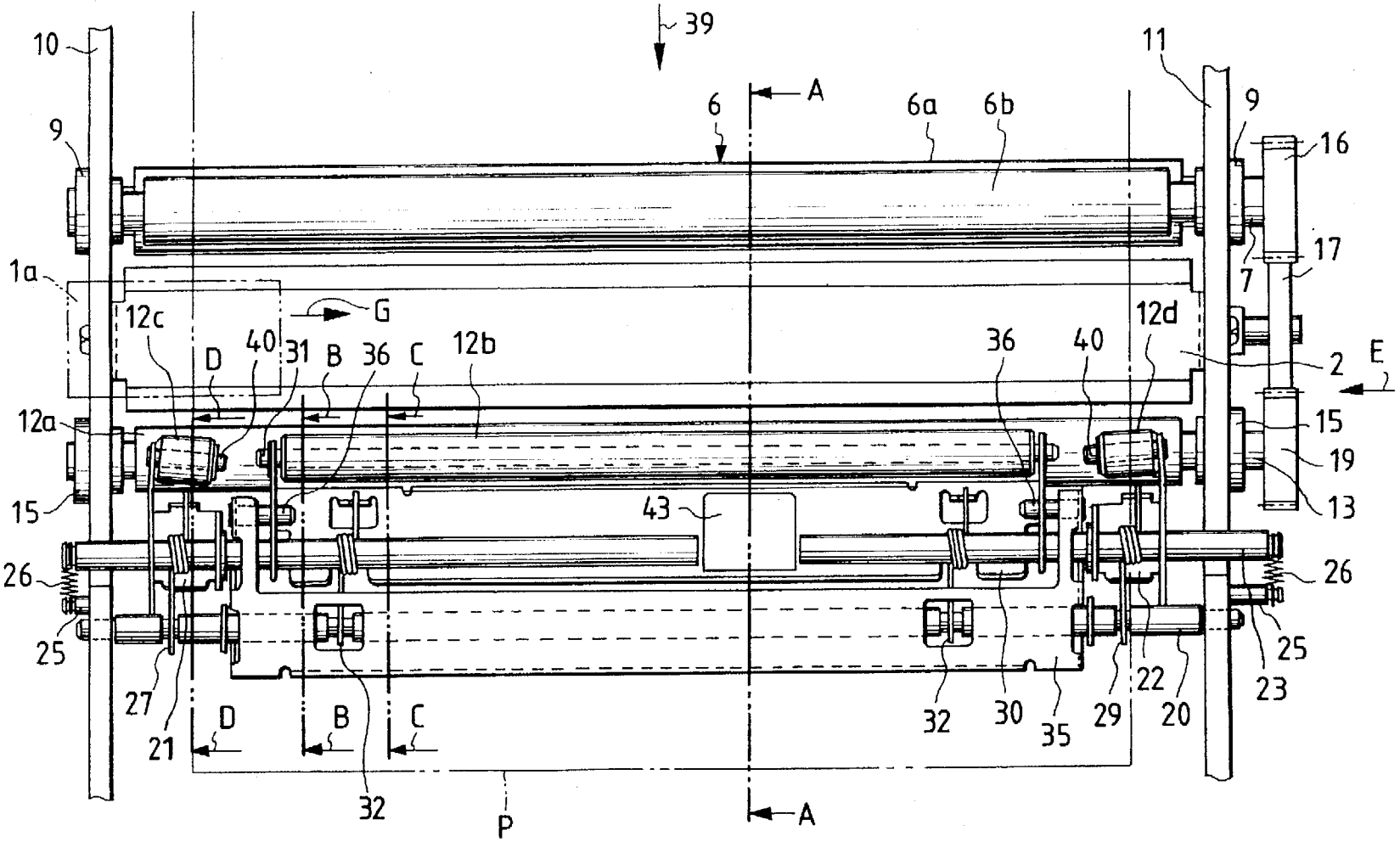
FIG. 1 is a plan view of a main portion of a liquid jet recording apparatus according to a preferred embodiment of the present invention.

The present invention will now be explained in connection with embodiments thereof with reference to the accompanying drawings. FIG. 1 shows a plan view of a recording apparatus according to a preferred embodiment of the present invention and FIG. 2 is a sectional view taken along the line A—A of FIG. 1.

Figure 2:
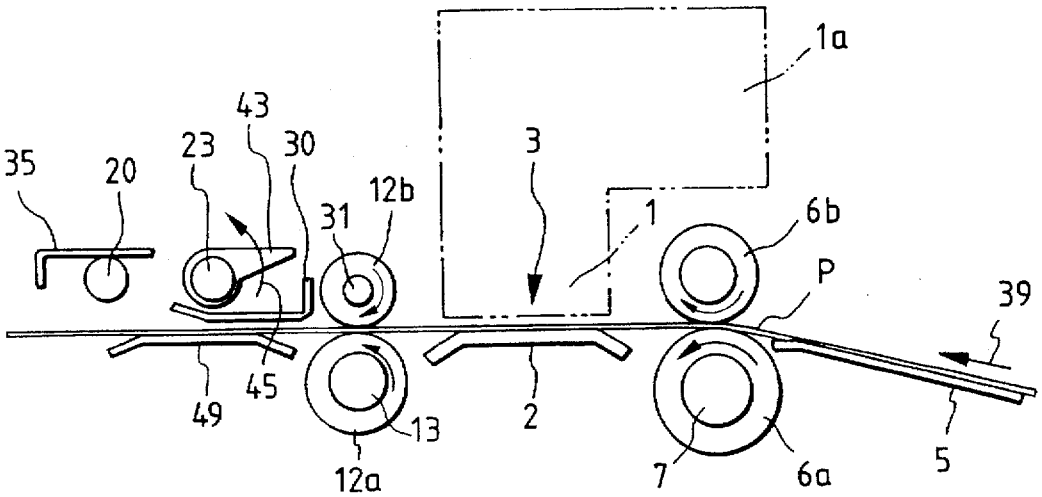
FIG. 2 is a sectional view taken along the line A—A of FIG. 1.
Figure 20:
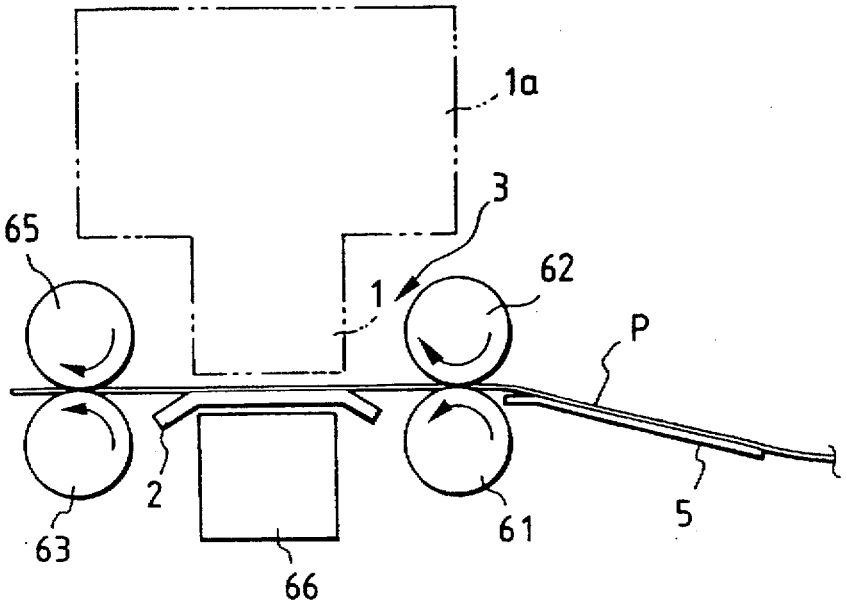
FIG. 20 PRIOR ART
FIGS. 20 to 23 show conventional image forming systems.
Figure 21:
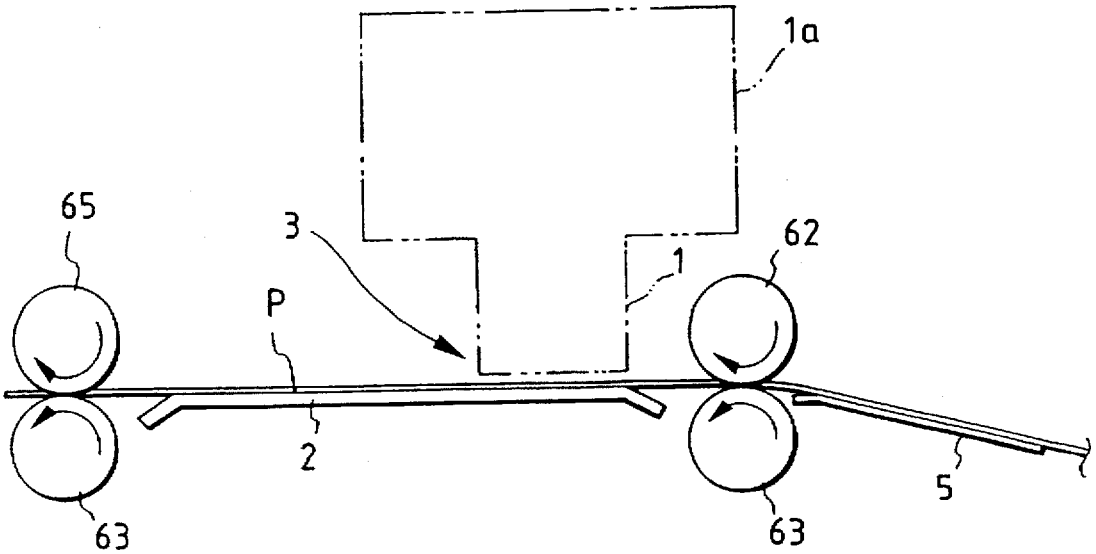
FIG. 21 PRIOR ART
Figure 22:
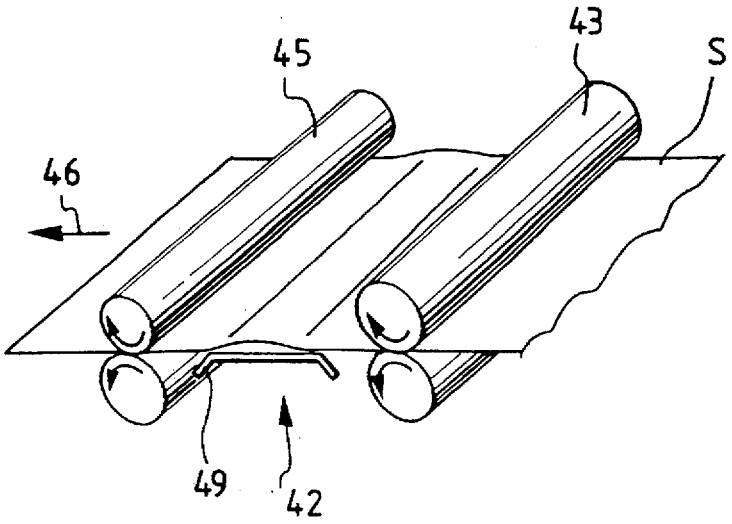
FIG. 22 PRIOR ART
Figure 23:
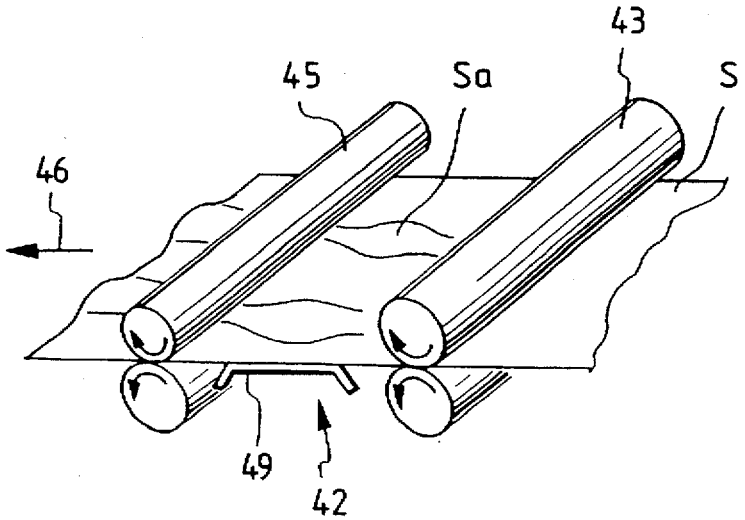
FIG. 23 PRIOR ART

In FIGS. 1 and 2, a pair of feed rollers 6 include a lower feed roller 6*a* and an upper feed roller 6*b* pressed against the lower roller and driven by the rotation of the lower roller. A shaft 7 on which the lower roller 6*a* is fixedly mounted is rotatably supported at its both ends by side plates 10 and 11, respectively, through bearings 9. At a downstream side of the paired rollers 6, a platen 2 similar to the conventional platen shown in FIG. 20 is arranged, and, at a downstream side of the platen, a pair of ejector rollers 12 are arranged. The pair of ejector rollers 12 include a lower ejector roller 12*a* and upper ejector rollers 12*b*, 12*c*, 12*d* pressed against the lower roller and driven by the rotation of the lower roller.

A shaft 13 on which the lower ejector roller 12*a* is fixedly mounted is rotatably supported by side plates 10 and 11, respectively, through bearings 15. A gear 19 fixed to one end of the shaft 13 is connected to a gear 16 fixed to one end of the shaft 7 of the lower feed roller 6*a* through an idle gear 17 rotatably mounted on the side plate 11. Incidentally, the peripheral speed of the lower ejector roller 12*a* is slightly faster than the peripheral speed of the lower feed roller 6*a*, thereby maintaining appropriate tension in a recording medium P being fed.

Figure 3:
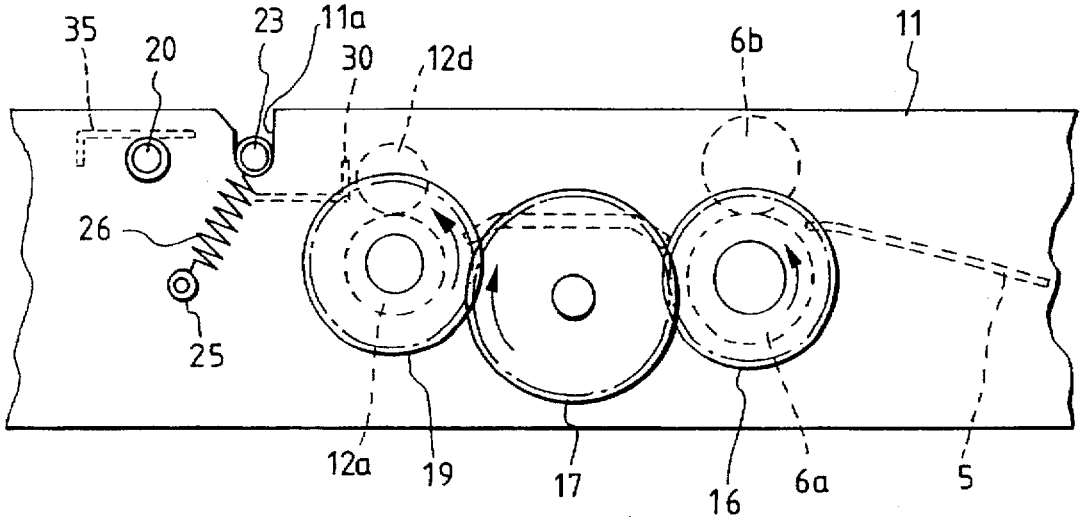
FIG. 3 is a view from the arrow E of FIG. 1.

A pair of opposed pressure plates 21, 22 are mounted at their base portions on both ends of an ejector shaft 20 rotatably mounted on the side plates 10, 11, and ejector pressure shafts 23 are rotatably mounted on the pressure plates 21, 22, respectively. As shown in FIG. 3, a tension spring 26 is connected at its one end to the ejector pressure shaft 23, the other end of the tension spring being anchored to a projection 25 formed on the side plate 11 (or 10). In this way, the ejector pressure shaft 23 is biased downwardly by the bias force of the tension spring 26. Further, each ejector pressure shaft 23 is received in and positioned by a bearing recess 11*a* formed in the side plate 11 or 10. Both ejector pressure shafts 23 have the same construction.

Figure 5:
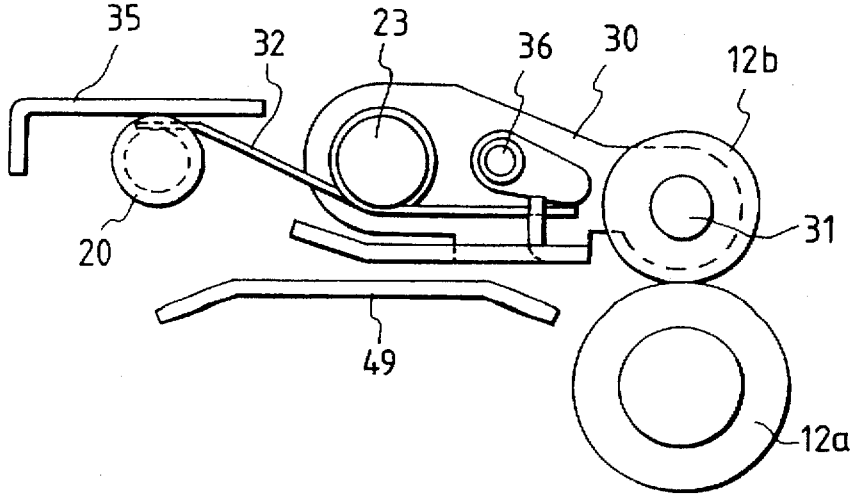
FIG. 5 is a sectional view taken along the line C—C of FIG. 1.
Figure 6:
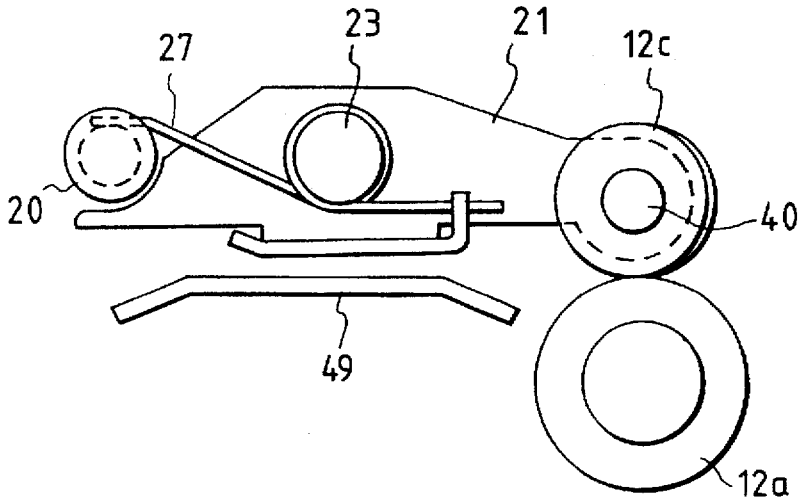
FIG. 6 is a sectional view taken along the line D—D of FIG. 1.

Next, a pressurizing mechanism for the upper ejector rollers 12*b*, 12*c* and 12*d* will be explained with reference to FIGS. 1, 5 and 6.

The upper ejector roller 12*c* is rotatably mounted on a free end portion of the pressure plate 21 through a shaft 40 in such a manner that the roller 12*c* is slightly inclined to orient the feeding direction of the roller 12*c* slightly outwardly. The pressure plate 21 is biased by a torsion coil spring 27 to be rotated in a direction where the upper ejector roller 12*c* is pressed against the lower ejector roller 12*a*. Each torsion coil spring 27 is wound around the ejector pressure shaft 23 and has one end engaged by the ejector shaft 20 and the other end engaged by the pressure plate 21. The upper ejector roller 12*d* is rotatably mounted on the other pressure plate 22 in the similar manner as the upper ejector roller 12*c* and is pressed against the lower ejector roller 12*a* by means of a torsion coil spring 29.

A pressure plate 30 is rotatably mounted at its both ends on central portions of the ejector pressure shafts 23, and the elongated upper ejector roller 12*b* is rotatably supported by bent portions of the pressure plate 30 through a shaft 31. The upper ejector roller 12*b* is urged against the lower ejector roller 12*a* by a pair of torsion coil springs 31' each of which is wound around the corresponding ejector pressure shaft 23 and has one end engaged by the ejector shaft 20 and the other end engaged by the pressure plate 30.

Figure 7:
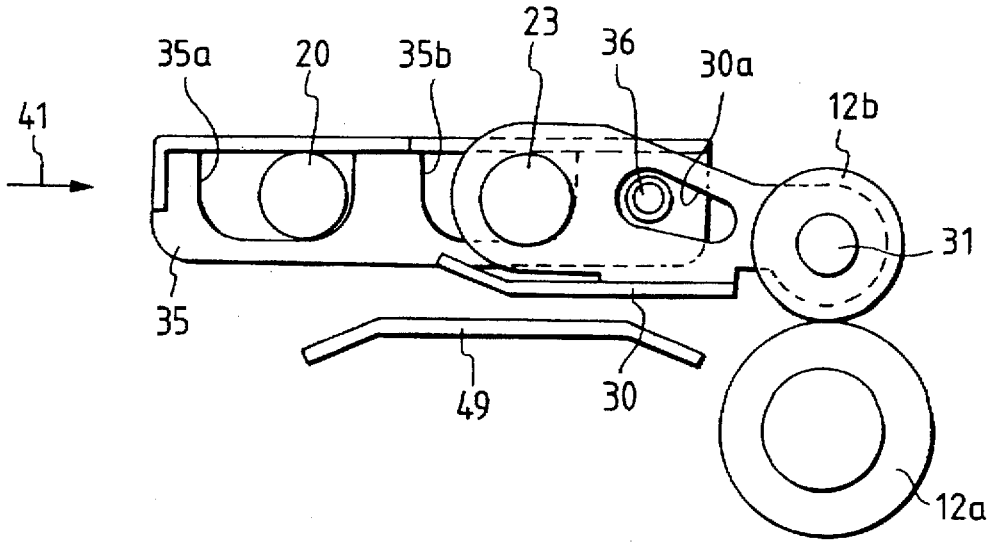
FIG. 7 is a sectional view taken along the line B—B of FIG. 1.
Figure 8:
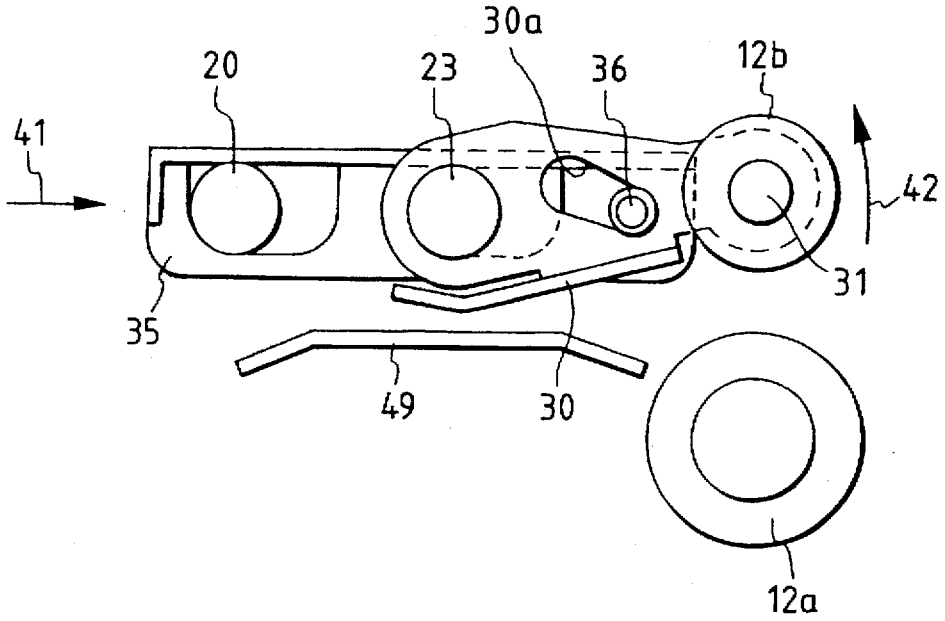
FIG. 8 is a sectional view similar to FIG. 7, but showing the operation of the apparatus.

FIGS. 7 and 8 show a pressure release mechanism for the upper ejector rollers 12*b*, 12*c* and 12*d*. In FIGS. 7 and 8, a pressure release plate 35 is provided at its both ends with a pair of bent portions. The pressure release plate is supported for a horizontal movement by receiving the ejector shaft 20 and the ejector pressure shaft 23 into slots 35*a*, 35*b* formed in the bent portions of the pressure release plate 35. Inwardly extending pins 36 fixed to both ends of the pressure release plate 35 are positioned into slots 30*a* formed in the bent portions of the pressure plate 30. An upper edge of each slot 30*a* is inclined in such a manner that the slot extends downwardly toward the upper ejector roller 12*b*.

Next, the operation of the illustrated embodiment having the above-mentioned construction will be explained.

The recording medium P fed in a direction shown by the arrow 39 (FIG. 1) is pinched between the lower feed roller 6*a* rotated by a driving means (not shown) and the upper feed roller 6*b* urged against the lower feed roller 6*a* by a pressure means (not shown) and driven by the rotation of the lower feed roller, and is conveyed toward the printing portion 3. A feeding movement of the recording medium P is regulated by the pair of feed rollers 6. The recording medium P is further fed until a leading end of the recording medium is pinched between the lower ejector roller 12*a* and the upper ejector rollers 12*b*, 12*c*, 12*d* pressed against and driven by the lower ejector roller, and is temporarily stopped at that position.

Incidentally, the pinching force provided by the pair of ejector rollers 12 for pinching the recording medium P is so selected as to be smaller than the pinching force of the pair of feed rollers 6. Further, by rotating the pair of ejector rollers 12 at a peripheral speed faster than that of the pair of feed rollers 6 and by pulling the recording medium P at an appropriate tension force in the transverse direction due to the specific inclination of the upper ejector rollers 12*c*, 12*d*, the recording medium P is prevented from floating (or wrinkling) on the platen 2 at the printing portion 3, thereby stabilizing the printing accuracy.

In this condition, a carriage 1*a* on which an ink jet head 1 is mounted is shifted in a direction shown by the arrow G in FIG. 1. The ink jet head 1 has jet elements for jetting liquid droplets by the use of thermal energy, whereby one-line printing is performed by jetting the liquid droplets from the jet elements. After one-line printing has been finished, by rotating the lower feed roller 6*a* by a predetermined amount, the recording medium P is fed in the direction shown by the arrow 39 by a predetermined amount, and then the operation for the next line printing is repeated. The recording medium P is fed downstreamly through between the pressure plates 30, 21, 22 (also acting as guides for the recording medium to be ejected) and a lower guide plate 40'. After the printing operations for the entire recording medium P have been finished, the recording medium P is ejected out of the apparatus by the pair of ejector rollers 12.

When the printing operation is carried out with repsect to the recording medium P, if a recording medium P having a slower fixing speed is used, by a driving means (not shown) or by the operator's manual operation, the pressure release plate 35 shown in FIG. 7 is shifted toward the direction shown by the arrow 41. When the pressure release plate 35 has been shifted in a position shown in FIG. 8, the pins 36 urge the upper edges of the corresponding slots 30*a* of the pressure plate 30 upwardly, thereby rotating the pressure plate 30 in a direction shown by the arrow 42 to separate the upper ejector roller 12*b* from the lower ejector roller 12*a*. In this condition, the pressure release plate 35 is held by a locking mechanism (not shown). In this case, the upper ejector rollers 12*c*, 12*d* positioned on both sides of the ejector roller 12*b* press the recording medium P against the lower ejector roller 12*a* to hold down a non-image area of the recording medium P. In this way, when the printing is effected with respect to the recording medium P having the slower fixing speed, by releasing the upper ejector roller 12*b* positioned in correspondence to an image area of the recording medium P from the lower ejector roller 12*a*, the recording medium P can be printed while it is being fed at a normal sheet feeding speed.

Next, the releasing operation for the upper ejector rollers 12*b*, 12*c*, 12*d* in the case where the recording medium P is not properly fed (jammed) will be explained with reference to FIGS. 1 to 4.

Figure 4:
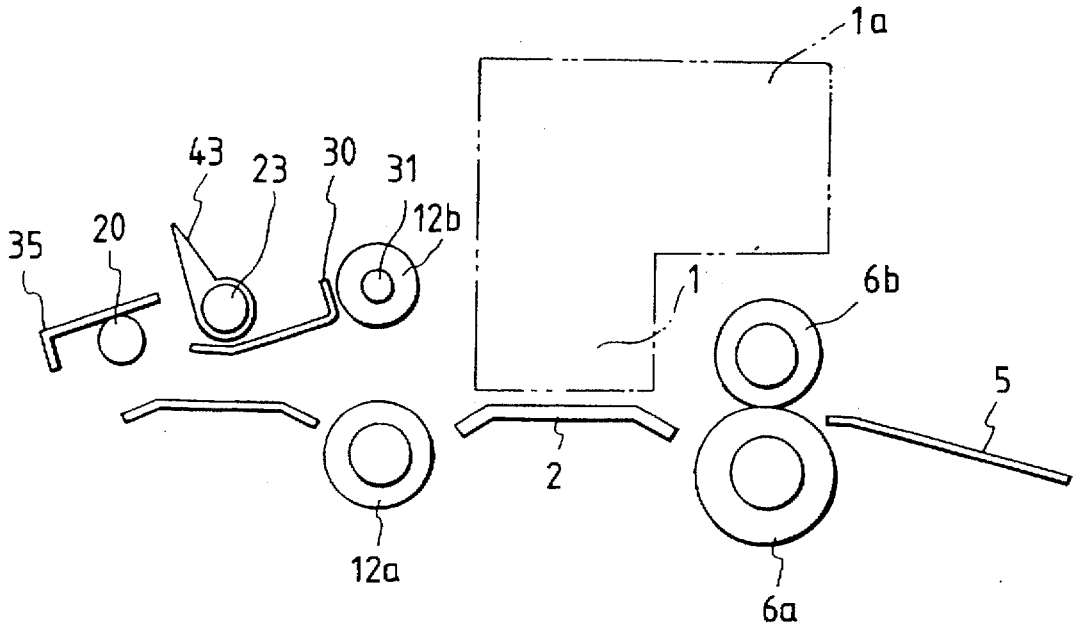
FIG. 4 is a sectional view similar to FIG. 2, but showing the operation of the apparatus.

In FIG. 2, when the recording medium P is jammed, the operator manipulates a release lever 43 formed integrally with the ejector pressure shaft 23 to rotate the same in the direction shown by the arrow 45, thereby releasing the locking mechanism (not shown) between the ejector pressure shafts 23 and the side plates 10, 11 and, further, by rotating the ejector pressure shafts 23 around the ejector shaft 20 as shown in FIG. 4, the pressurization by means of the pair of ejector rollers 12 is released. In this condition, the jamming of the recording medium P is cured.

Incidentally, in the illustrated embodiment, while the upper ejector rollers 12*b*, 12*c*, 12*d* were driven by the rotation of the lower ejector roller 12*a*, the lower ejector roller 12*a* may be driven, or both upper and lower ejector rollers may be driven.

Figure 10:
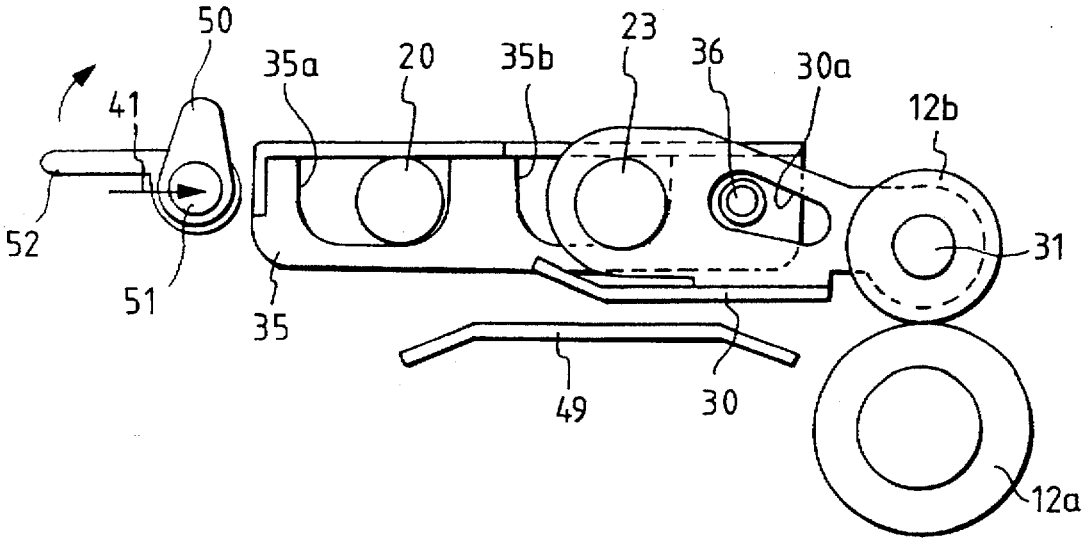
FIG. 10 is a sectional view taken along the line B—B of FIG. 9.
Figure 9:
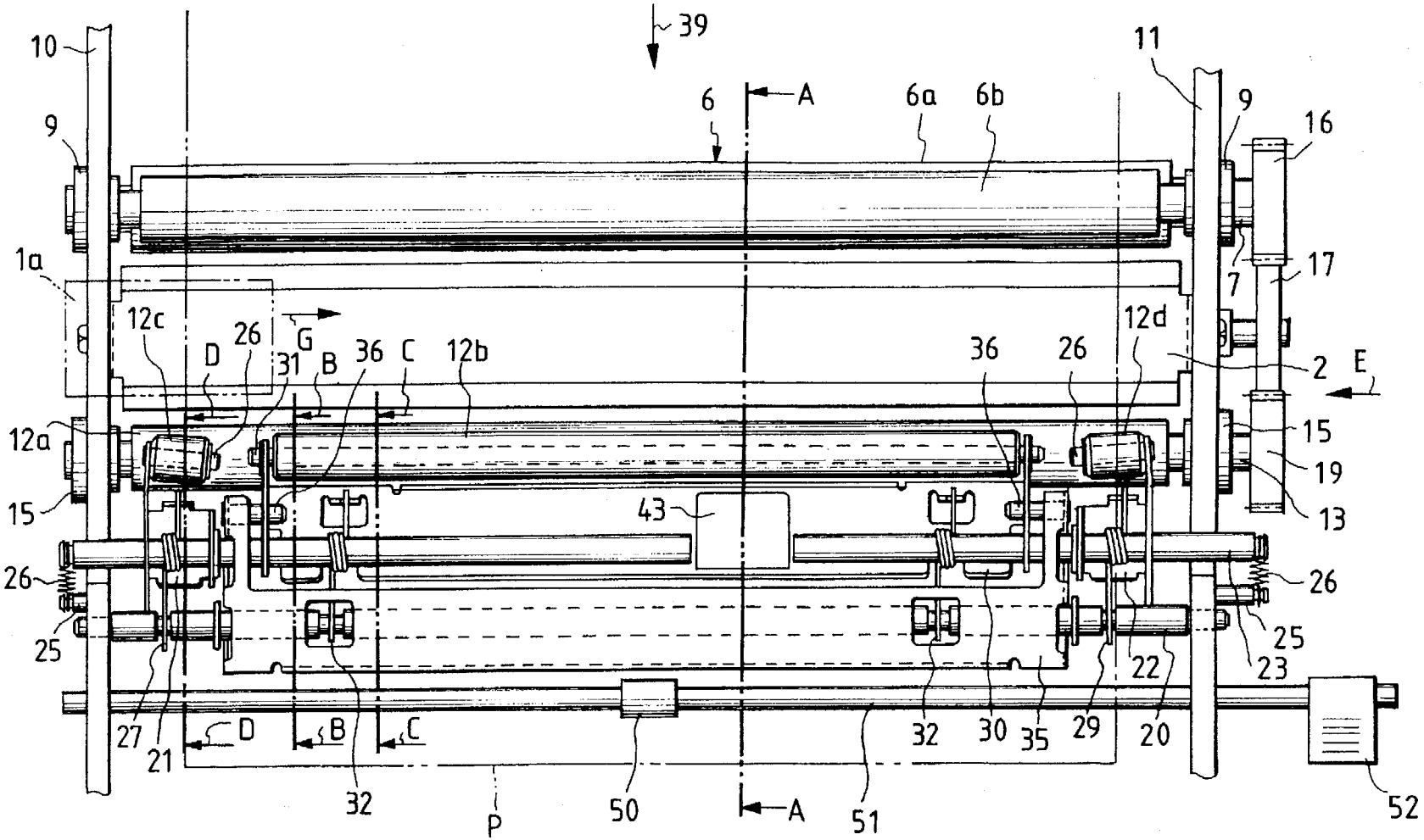
FIG. 9 is a plan view of a main portion of a liquid jet recording apparatus according to a second embodiment of the present invention, wherein a manual operation is available.
Figure 11:
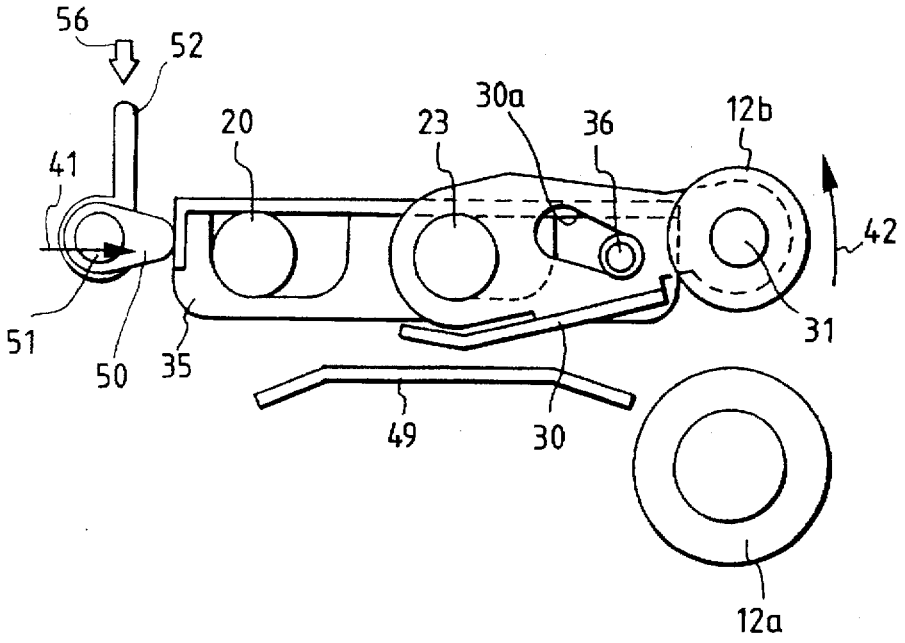
FIG. 11 is a sectional view similar to FIG. 10, but showing the operation of the apparatus.

FIGS. 9 to 11 show a mechanism for releasing the pressurization of the upper ejector roller 12*b*.

A cam 50 and an operation handle 52 are fixedly mounted on a shaft 51 rotatably supported by the side plates 10, 11. When the operation handle 52 is manually rotated, from a position shown in FIG. 10 where the upper ejector roller 12*b* is pressed against the lower ejector roller 12*a*, in a clockwise direction, the cam 50 will also be rotated in the clockwise direction, thus urging the pressure release plate 35 to the right, with the result that the pins 36 urge the upper edges of the corresponding slots 30*a* of the pressure plate 30 to rotate the latter in the direction shown by the arrow 42, thereby separating the upper ejector roller 12*b* from the lower ejector roller 12*a*. Incidentally, the operation handle 52 is so arranged that it can be manipulated from outside of a cover (not shown) of the recording apparatus, and a marker 56 (FIG. 11) is provided on the cover, which marker designates a position where the operation handle 52 is to be shifted when the recording medium such as an OHP sheet having a slower fixing speed is used.

Figure 12:
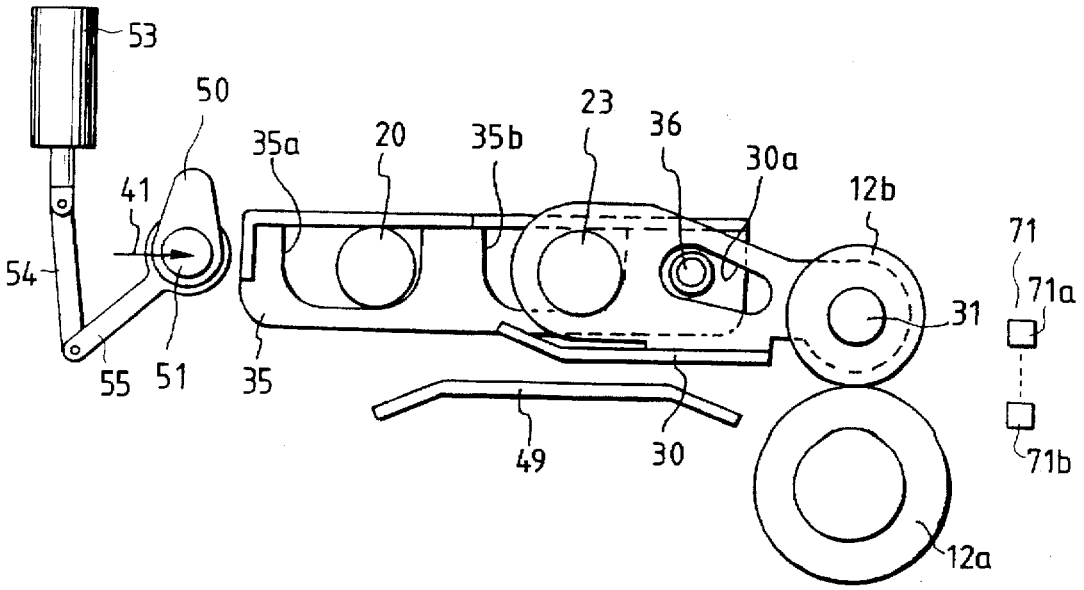
FIG. 12 is a sectional view similar to FIG. 10, but showing an embodiment wherein an electromagnetic actuator is available.

FIG. 12 shows a pressure release mechanism wherein the pressurization of the upper ejector roller 12*b* is released by means of an electromagnetic actuator 53 in place of the operation handle 52. When the electromagnetic handle 52 is energized, a link 54 is shifted upwardly to rotate the shaft 51 through a lever 55, thereby shifting the pressure release plate 35 to the right as in the case of FIG. 11 to separate the upper ejector roller 12*b* from the lower ejector roller 12*a*.

Figure 13A:
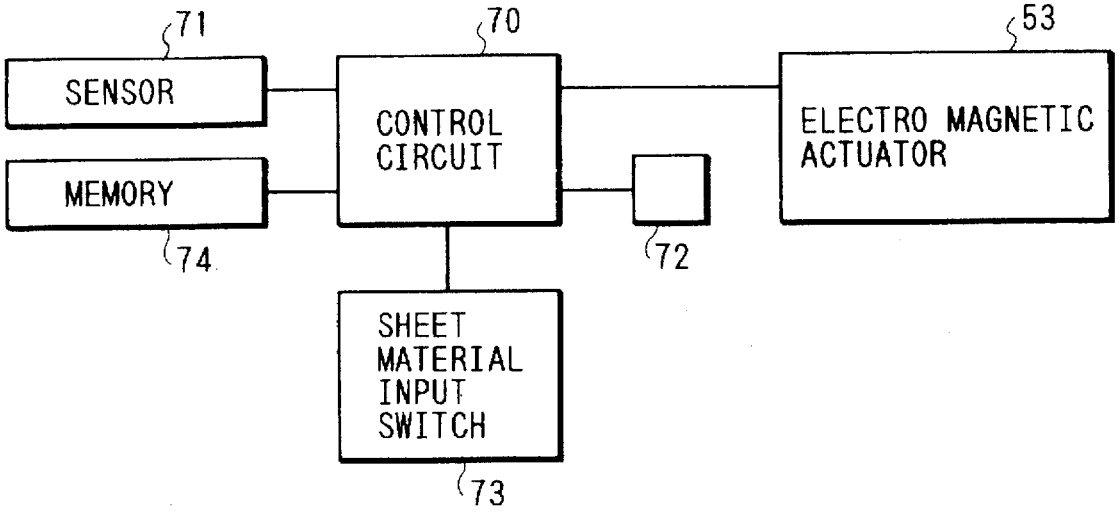
FIG. 13A is a block diagram of a driving circuit for driving the electromagnetic actuator.

FIG. 13A shows a circuit for driving the electromagnetic actuator shown in FIG. 12. In FIG. 13A, the reference numeral 70 denotes a control circuit; and 71 denotes a sensor comprising a light emitting element 71*a* and a light receiving element 71*b*. When the normal sheet (recording medium) encounters with the sensor 71, the light emitted from the light emitting element 71*a* is blocked by the sheet, with the result that the light does not reach the light receiving element 71*b*. On the other hand, when the transparent OHP sheet encounters with the sensor, the light emitted from the light emitting element 71*a* can reach the light receiving element 71*b*. Therefore, if the light receiving element 71*b* does not generate a signal during the passage of the sheet through the sensor (between the elements 71*a*, 71*b*), the control circuit 70 determines the fact that the normal sheet is being fed, and thus, does not energize the electromagnetic actuator 53. However, if the light receiving element 71*b* generates the signal during the passage of the sheet through the sensor, the control circuit determines the fact that the sheet being fed is the OHP sheet having the slower fixing speed, and energizes the electromagnetic actuator 53.

Alternatively, in place of the sensor 71, an ON/OFF switch 72 which is turned ON manually when the sheet having the slower fixing speed is fed may be provided.

Figure 13B:
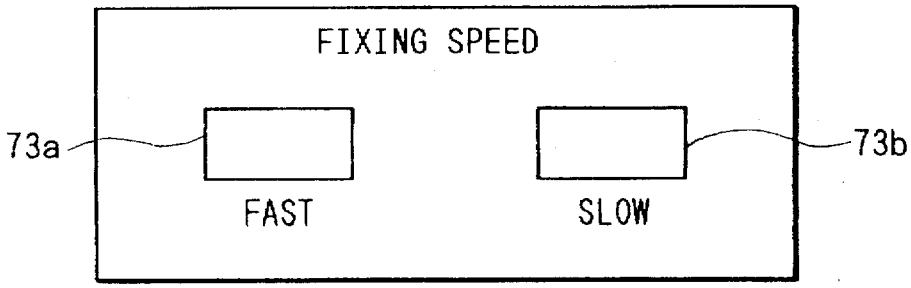
FIG. 13B is a view showing an alteration of a sensor of FIG. 13A.

Further, a sheet material input switch 73 may be provided. In this case, sheet material information inputted by the switch 73 is stored in a memory 74, and, if the sheet having the slower fixing speed is used, the electromagnetic actuator is energized on the basis of the sheet material information. The sheet material input switch 73 is constituted in such a manner that the fixing speed of the sheet can be inputted by pushing either button 73*a* or 73*b*, as shown in FIG. 13B.

Figure 14:
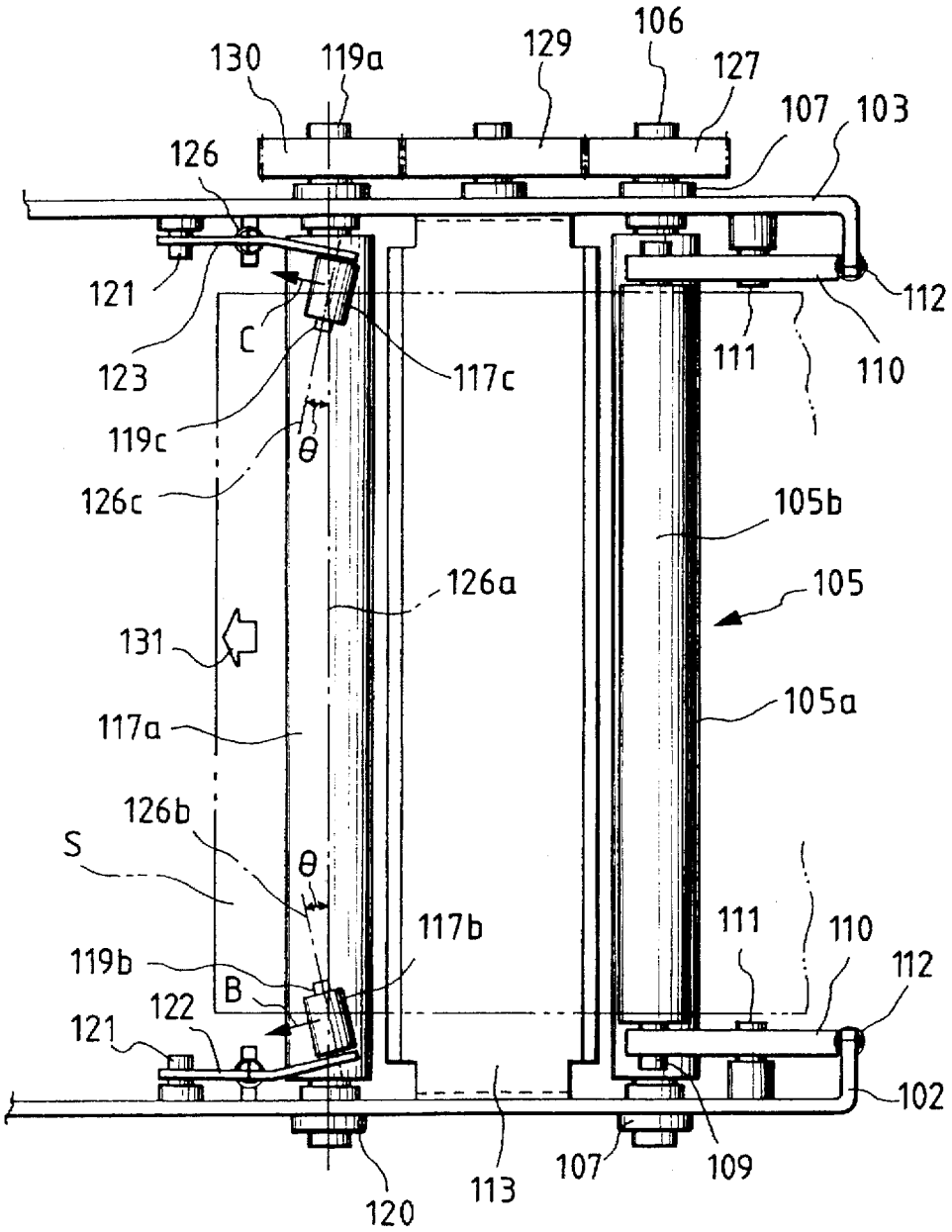
FIG. 14 is a plan view of a sheet feeding mechanism in an image forming system according to a further embodiment of the present invention.

Next, another embodiment of the present invention will be explained with reference to FIGS. 14 and 15. FIG. 14 is a plan view of a sheet feeding mechanism positioned near a printing portion of an image forming system according to this embodiment, and FIG. 15 is a sectional view of the sheet feeding mechanism.

Figure 15:
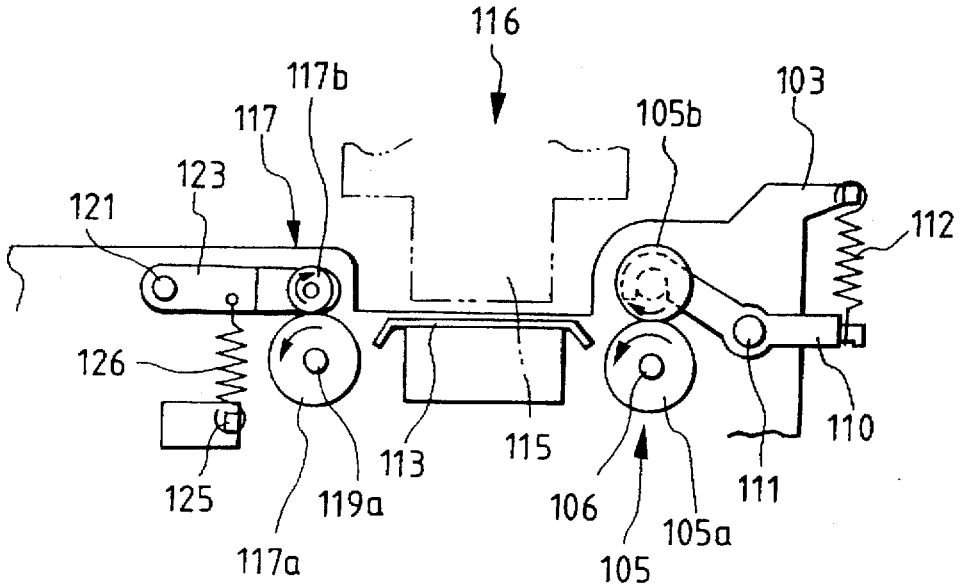
FIG. 15 is a cross-sectional view of the sheet feeding mechanism of FIG. 14.

In FIGS. 14 and 15, a shaft 106 on which a lower feed roller 105*a* is fixed is rotatably supported by left and right side plates 102, 103 through bearings 107, respectively. An upper feed roller 105*b* pressed against a peripheral surface of the lower fed roller 105*a* is fixed to a shaft 109, both ends of which are received in and held by recesses formed in ends of pressure arms 110, respectively. The pressure arms 110 are pivotably mounted on the side plates 102, 103, respectively, through respective shafts 111 and are biased by corresponding tension springs 112 toward the direction where the upper feed roller 105*b* is pressed against the lower feed roller 105*a*. Each tension spring 112 has one end engaged by the corresponding pressure arm 110 and the other end engaged by the side plate 102 or 103. A pair of feed rollers 105 are constituted by these lower and upper feed rollers 105*a* and 105*b*.

At a downstream side of the pair of feed rollers 105, there is arranged a printing portion 116 including a platen 113 fixed at its both ends of the side plates 102, 103 and a printing means 115 positioned above the platen. If the image forming system is an ink jet printer, the printing means 115 is constituted by an ink jet head which causes the change in condition including the formation of bubbles in liquid by utilizing thermal energy, thereby forming liquid droplets to record an image on a recording medium.

A pair of tension rollers 117 arranged at a downstream side of the printing portion 116 comprise a lower tension roller 117*a* and a plurality of upper tension rollers 117*b*, 117*c* pressed against the lower tension roller at both ends thereof. Both ends of a shaft 119*a* on which the lower tension roller 117*a* is fixed mounted are rotatably supported by the side plates 102, 103 through bearings 120, respectively. The upper tension rollers 117*b*, 117*c* are pivotably mounted, through shafts 119*b*, 119*c*, on ends of pressure levers 122, 123 which are pivotably supported by the side plates 102, 103 through shaft 121, respectively. The pressure levers 122, 123 are biased by corresponding tension springs 126 toward the direction where the upper tension rollers 117*b*, 117*c* are pressed against the lower tension roller 117*a*. Each tension spring 126 has one end engaged by the other end portion of the corresponding pressure lever and the other end engaged by a projection 125 formed on the side plate 102 or 103.

Further, the upper tension rollers 117*b*, 117*c* are inclined in such a manner that axes 126*b*, 126*c* of the upper rollers form angles θ with respect to an axis 126*a* of the lower tension roller 117*a* so that an inner end of each upper roller is situated at a downstream side of an outer end of each upper roller with respect to a sheet feeding direction. With this arrangement, the sheet feeding force produced between the lower tension roller 117*a* and the upper tension roller 117*b* is oriented slightly outwardly as shown by the arrow B. Similarly, the sheet feeding force produced between the lower tension roller 117*a* and the upper tension roller 117*c* is oriented slightly outwardly as shown by the arrow C.

A gear 127 fixed to one end of the shaft 106 of the lower feed roller 105*a* is connected to a gear 130 fixed to the shaft of the lower tension roller 117*a* through an idle gear 129 rotatably supported by the side plate 103, so that when the lower feed roller 105*a* is rotated by a driving source (not shown) in a direction shown by the arrow the lower tension roller 117*a* is synchronously rotated in a direction shown by the arrow. Incidentally, a peripheral speed of the lower tension roller 117*a* and the upper tension roller 117*b* driven by the rotation of the lower tension roller is so selected as to be faster than a peripheral speed of the lower feed roller 105*a* and the upper feed roller 105*b* driven by the rotation of the lower feed roller.

Further, the pinching force of the pair of feed rollers 105 produced by the tension springs 112 is so selected as to be greater than the pinching force of the pair of tension rollers 117 produced by the tension springs 126. Incidentally, the upper tension rollers 117*b*, 117*c* are so situated that a portion of each upper roller is pressed against an edge portion of a sheet S to be fed and the other portion of each upper roller is directly pressed against the peripheral surface of the lower tension roller 117*a*.

Next, the operation of this embodiment will be explained.

The sheet S fed to the pair of feed rollers 105 by a supply roller (not shown) is pinched between the lower and upper feed rollers 105*a*, 105*b* and is fed onto the platen 113, and, further, is introduced between the lower tension roller 117*a* and the upper tension rollers 117*b*, 117*c*. At this point, the sheet S is stopped temporarily, and the printing means 115 such as the ink jet head scans the sheet S to perform one-line printing. Thereafter, the feeding of the sheet by a predetermined amount and the one-line printing are repeated alternately until the entire image area of the sheet is printed.

During the printing operation, if the sheet S were to float from the platen 113, there will arise a drawback that the printing surface of the sheet is smeared due to the contact between the sheet S and the printing means 115. However, in this embodiment, as mentioned above, the sheet S is moderately tensioned in the sheet feeding direction by rotating the pair of tension rollers 117 at the peripheral speed faster than that of the pair of feed rollers 105 and further the sheet is also moderately tensioned in the transverse direction since the sheet is pulled outwardly in the transverse direction by inclining the upper tension rollers 117*b*, 117*c* by the angle θ.

Consequently, since the sheet S is not floated or slacked above the platen 113, the contact between the sheet and the printing means 115 can be avoided, thus preventing the printing surface of the sheet from smearing. Further, in the image forming system which treats a sheet having non-image areas (blank spaces) on both edge portions, since the upper tension rollers 117*b*, 117*c* can be pressed against the non-image areas of the sheet, high quality images on the recording sheet can be maintained. Incidentally, the inclination angle θ of the upper tension rollers 117*a*, 117*b* is preferably about 2 degrees, because if the angle is too small the pulling force for pulling the sheet outwardly will be weaker, whereas if the angle is too great the upper rollers will not be effectively driven by the rotation of the lower tension roller.

Figure 17:
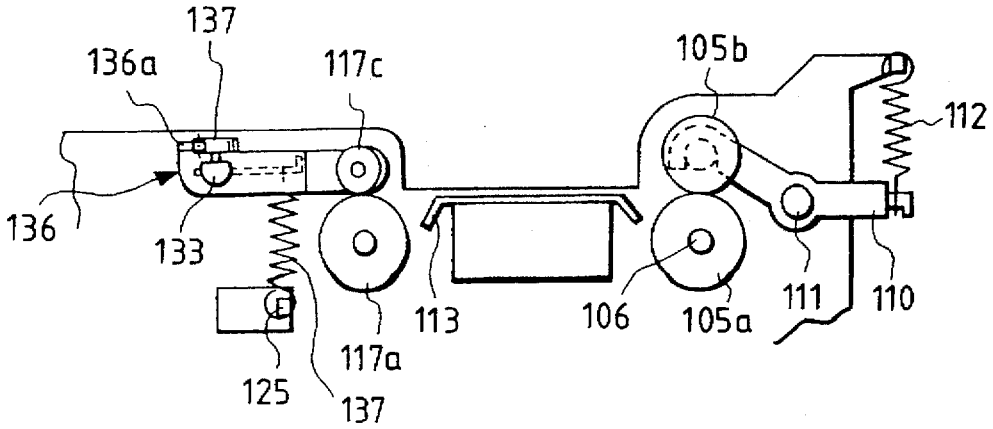
FIG. 17 is a cross-sectional view of the sheet feeding mechanism of FIG. 16.
Figure 16:
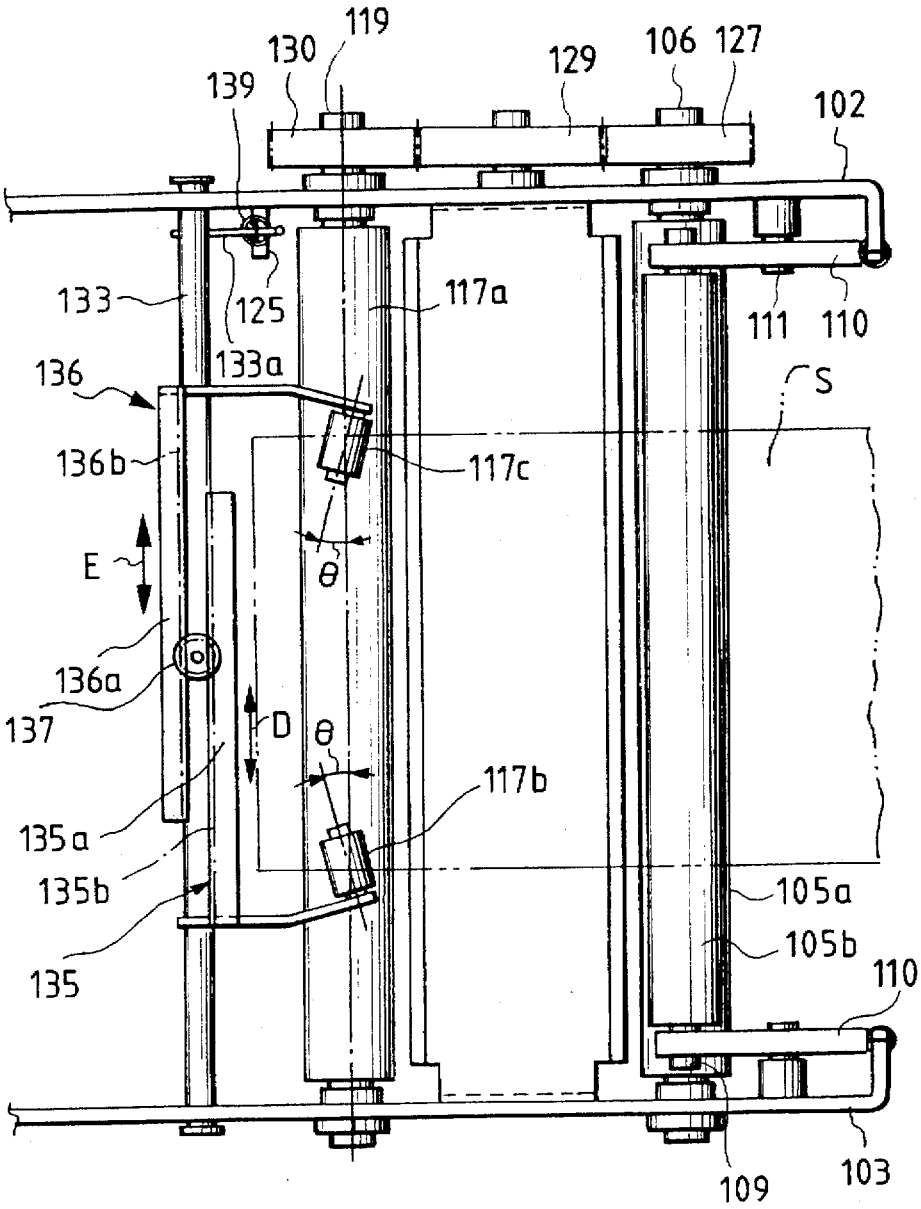
FIG. 16 is a plan view of a sheet feeding mechanism in an image forming system according to a still further embodiment of the present invention.

FIGS. 16 and 17 show a further embodiment of the present invention. In this embodiment, a supporting structure for supporting the upper tension rollers differs from that of the previous embodiment.

A shaft 133 is rotatably supported by the side plates 102, 103, which shaft 133 has a flat surface as a portion of a peripheral surface thereof. Pressure members 135, 136 are slidably but non-rotatingly mounted on the shaft 133. On free ends of the pressure members 135, 136, the upper tension rollers 117*b*, 117*c* are mounted in the inclined conditions, respectively, similar to the previous embodiment. Legs 135*a*, 136*a* are formed on base portions of the pressure members 135, 136, respectively, these legs extending parallel to the shaft 133. Racks 135*b*, 136*b* attached to the legs 135*a*, 136*a*, respectively, in confronting relation to each other are meshed with a pinion 137 rotatably mounted on a central portion of the shaft 133. The shaft 133 is biased, by means of tension springs 139, toward the direction where the upper tension rollers 117*b*, 117*c* are pressed against the lower tension roller 117*a*. Each tension spring 139 has one end engaged by a projection 125 formed on the side plate 102 or 103 and the other end engaged by the shaft 133.

With the arrangement mentioned above, if either pressure member 135 or 136 is slid along the shaft 133 in a direction shown by the arrow D or E to set a desired sheet size, the other pressure member 136 or 135 is also slid automatically synchronously synchronous with the movement of the former pressure member, whereby these pressure members can easily be positioned above the non-image area of the sheet. That is to say, even in the image forming system wherein various sheets having different sizes are fed by utilizing the central line of the sheet as a reference line, the floating of the sheet can be prevented by simply sliding the pressure members 135, 136. Incidentally, in the image forming system wherein the sheet is fed by utilizing one edge of the sheet as a reference line, it should be noted that only one of the pressure members may be slidable or shiftable.

In the illustrated embodiments, since an example that the printing means 115 directs downwardly, the pair of tension rollers 117 are, of course, arranged in an up-and-down direction; further, while the lower tension roller 117*a* was constituted by the elongated single roller and the upper tension rollers were constituted by a plurality of rollers, these upper and lower rollers may be arranged inversely, i.e., a single roller may be arranged upwardly whereas a plurality of rollers may be arranged downwardly.

Further, the printing direction of the printing means 115 and/or the arrangement of the pair of tension rollers 117 are not limited to the illustrated embodiments, for example, the pair of tension rollers 117 may be arranged horizontally in the case where a transverse printing mode wherein the sheet S is fed in the up-and-down direction is adopted. Also in this case, the same advantages as those of the previous embodiments can be obtained.

Further, in the above-mentioned embodiments, while the sheet was tensioned in the transverse direction by the inclined upper ejector rollers 12*c*, 12*d*, 117*b*, 117*c*, the sheet may be tensioned in the transverse direction by using conical rollers having axes parallel to the lower ejector rollers 12*a*, 117*a* and having outer diameters decreasing outwardly.

As shown in FIG. 1, the ink jet head acting as the printing means is mounted on the carriage 1*a* and can record the image on the recording medium P fed by the pair of feed rollers 6.

The ink jet recording system includes liquid discharge openings for discharging the ink as flying ink droplets, liquid passages communicated with the discharge openings, and discharge energy generating means arranged in the liquid passages, for applying discharge energy to the ink in the liquid passages to form the flying ink droplets. The discharge energy generating means are energized in response to an image signal, thereby discharging the ink droplets toward the recording medium to form the image.

The discharge energy generating means may comprise a pressure energy generating means such as an electrical/mechanical converter (for example, an piezo-electric element), an electromagnetic energy generating means for generating the flying droplets by radiating the electromagnetic wave such as a laser beam onto the ink, or a thermal energy generating means such as an electrical/thermal converter. Among them, it is preferable to use the thermal energy generating means such as the electrical/thermal converter, because the discharge openings can be arranged with considerably high density (i.e., very closely) and the recording head can be small-sized. Further, in the illustrated embodiments, as the printing means or recording means, a bubble jet recording system which is one of the ink jet recording means is utilized.

Figure 18:
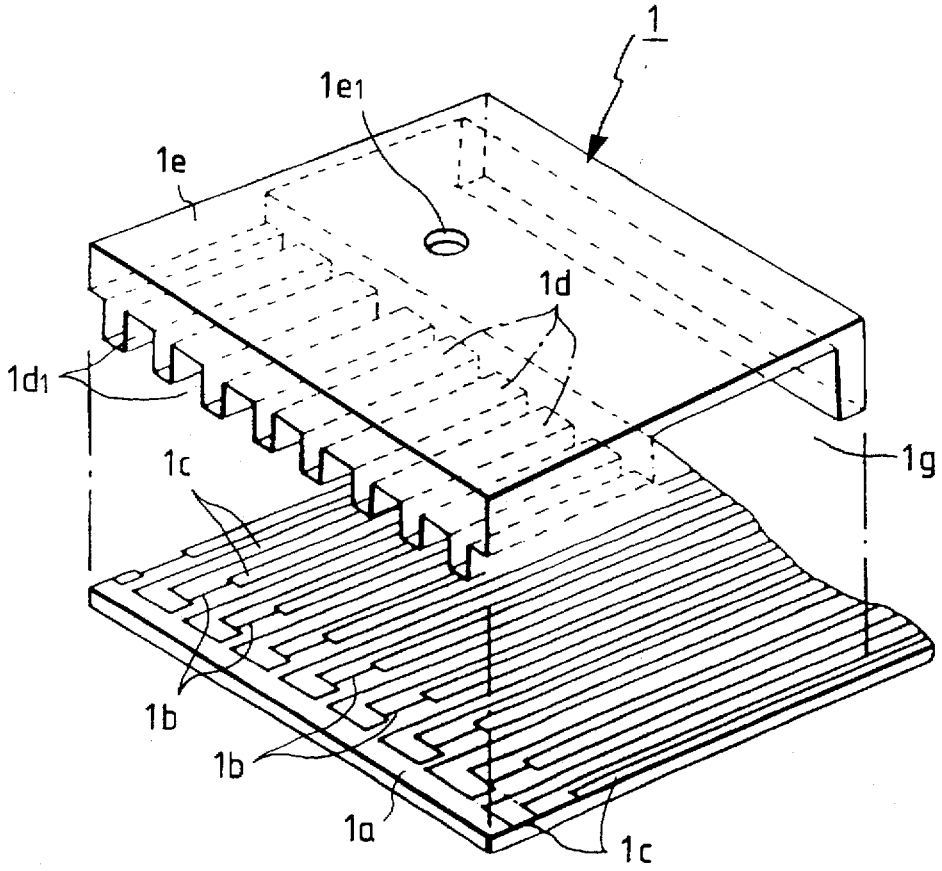
FIG. 18 and FIGS. 19A–19G show the details of an ink jet head.

FIG. 18 shows a construction of the ink jet head 1 constituting the recording means, and FIGS. 19A to 19G show a principle of the recording of the bubble jet recording system.

In FIG. 18, a heater board 1*h* made of silicone substrate on which electrical/thermal converters (discharge heaters) 1*b* and electrodes 1*c* made of aluminum and the like for supplying the electric power to the heaters are printed. A top plate 1*e* having partition walls for defining recording liquid passages (nozzles) is welded to the heater board 1*h* to complete the ink jet head.

The ink supplied through an appropriate conduit is introduced into a common liquid chamber 1*g* formed within the recording head 1 through a supply inlet port $1e_1$ and is supplied to the nozzles 1*d* from the common liquid chamber 1*g*. Each nozzle 1*d* has an ink discharge opening $1d_1$. These ink discharge openings $1d_1$ are faced to the recording medium P and are positioned at a predetermined pitch in the recording medium feeding direction.

Now, the principle for flying the ink droplets in the bubble jet recording system will be explained with reference to FIGS. 19A to 19G.

Figure 19A:
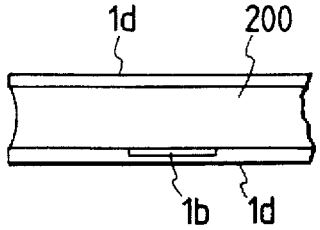
Figure 19B:
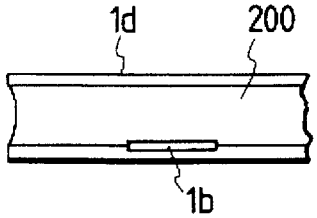
Figure 19C:
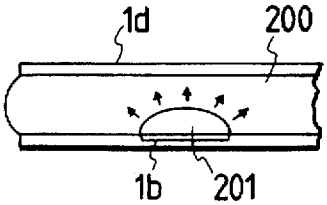

In the steady state condition, as shown in FIG. 19A, an outer surface of the ink 200 situated in the nozzle 1*d* is stabilized at the discharge opening by a surface tension of the ink and an external force. In this condition, when it is desired to eject the ink droplet, the electrical/thermal converter 1*b* arranged in the nozzle 1*d* is energized to generate the rapid increase in temperature of the ink 200 in the nozzle 1*d* exceeding the nucleate boiling point. Consequently, as shown in FIG. 19B, the ink 200 adjacent the electrical/thermal converter 1*b* is heated to create a bubble therein, and the film boiling is caused by vaporizing the heated ink, thereby growing the bubble 201 rapidly, as shown in FIG. 19C.

Figure 19D:
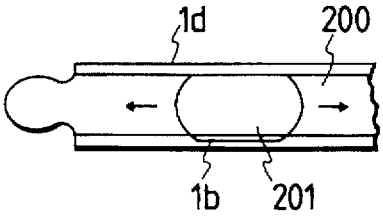

As shown in FIG. 19D, when the bubble 201 grows up to the maximum point, the ink droplet is pushed out of the discharge opening of the nozzle 1*d*. The ink droplet is ejected at the discharge speed toward the recording medium to form an ink image on the recording medium.

Figure 19E:
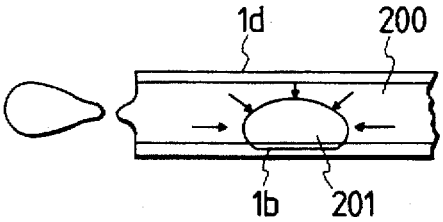
Figure 19F:
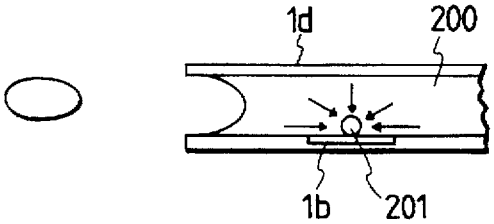
Figure 19G:
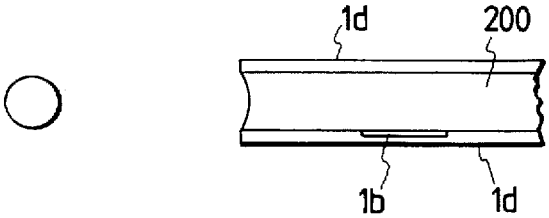

When the electrical/thermal converter 1*b* is disenergized, as shown in FIG. 19E, the grown bubble 201 is cooled by the ink 200 in the nozzle 1*d* to be contracted, and then, the bubble 201 disappears or is contracted to a negligible volume rapidly by contacting the ink with the cooled electrical/thermal converter 1*b* (see FIG. 19F). When the bubble 201 is contracted completely, as shown in FIG. 19G, the ink is supplied into the nozzle 1*d* from the common liquid chamber 1*g* by the capillary phenomenon to ready for the next energization of the electrical/thermal converter.

Accordingly, the image can be recorded on the recording medium by energizing the electrical/thermal converters 1*b* in response to the image signal, synchronously with the movement of the carriage 1*a*.

What is claimed is:

1. An image forming system comprising:

an image forming means, comprising an ink jet head for applying ink droplets to a sheet, for forming an image on the sheet;

a first feeding means arranged at an upstream side of said image forming means, for pinching the sheet and feeding the sheet in a sheet feeding direction to said image forming means; and a second feeding means arranged at a downstream side of said image forming means, for pinching and feeding the sheet on which the image is formed at a speed faster than a speed of said first feeding means, said second feeding means including a first rotary member rotating by contacting one side portion of the sheet, and a second rotary member rotating by contacting another side portion of the sheet, wherein rotary axes of said first rotary member and said second rotary member are obliquely disposed so that ends of said first rotary member and said second rotary member disposed closer to a central portion of the sheet are positioned further downstream than opposing ends of said first rotary member and said second rotary member with respect to the sheet feeding direction, thereby applying a tension force to the sheet in a direction transverse to the sheet feeding direction.

2. An image forming system according to claim 1, wherein said image forming means comprises an ink jet head for jetting ink droplets onto the sheet.

3. An image forming system according to claim 1, wherein said image forming means comprises a recording head for applying ink droplets generated by thermal energy to the sheet.

4. An image forming system according to claim 1, wherein said first feeding means comprises a pair of rollers which are rotated while pinching the sheet therebetween.

5. An image forming system according to claim 1, wherein said second feeding means further comprises a third rotary member which pinches the sheet in cooperation with the first rotary member and the second rotary member.

6. An image forming system according to claim 1, wherein said first and second rollers contact areas of the sheet where the image is not formed.

7. An image forming system according to claim 6, further comprising a third rotary member cooperating with said first and second rotary members to nip the sheet, and a fourth rotary member disposed between said first and second rotary members cooperating with said third rotary member to nip the sheet.

8. An image forming system according to claim 7, further including a shifting means for shifting said fourth rotary member between a first position where the sheet is pinched between said fourth rotary member and said first rotary member, and a second position where the sheet is not pinched between said first and fourth rotary members.

9. An image forming system according to claim 8, further including an information emitting means for emitting information regarding material type of the sheet to be fed; and wherein said shifting means shifts said fourth rotary member based on the information emitted from said information emitting means.

10. An image forming system according to claim 9, wherein said information emitting means comprises an input means for inputting the material of the sheet.

11. An image forming system according to claim 9, wherein said recording means forms the image by ink droplets and said shifting means shifts said fourth rotary member to the second position in accordance with the fixing speed of the ink.

12. An image forming system according to claim 2, wherein each of said first and second roller rotary members is in the form of a cone having an outwardly decreasing diameter in the transverse direction to apply to the sheet a feeding force directed outwardly in the transverse direction of the sheet.

13. An image forming system according to claim 1, wherein said second feed means has a discharge roller.

14. An image forming system according to claim 1, wherein said second feeding means has a discharge roller.

15. An image forming system comprising:

an image forming means for forming an image on a sheet;

a feeding means arranged at an upstream side of said image forming means, for pinching the sheet and for feeding the sheet in a sheet feeding direction to said image forming means;

a first rotary member arranged at a downstream side of said image forming means, for applying to the sheet a feeding force by contacting the sheet;

second and third rotary members disposed separated from each other and with their axial directions transverse to the sheet feeding direction, for pinching the sheet in cooperation with said first rotary member;

a fourth rotary member arranged between said second and third rotary members, for pinching the sheet in cooperation with said first rotary member; and a shifting means for shifting said fourth rotary member between a first position where the sheet is pinched between said fourth rotary member and said first rotary member, and a second position where the sheet is not pinched between said first and said fourth rotary members.

16. An image forming system according to claim 15, wherein said image forming means comprises an ink jet head for jetting ink droplets onto the sheet.

17. An image forming system according to claim 16, wherein said second and third rotary members contact areas of the sheet where images are not formed.

18. An image forming system according to claim 15, further including a control means for controlling said shifting means in response to a material of the sheet.

19. An image forming system according to claim 15, further including an operation means for manually operating said shifting means.

20. An image forming system according to claim 19, further including a marker means for indicating a position to which said operation means should be manipulated.

21. An image forming system comprising:

an image forming means, comprising an ink jet head applying ink droplets to a sheet, for forming an image on the sheet;

a first feeding means arranged at an upstream side of said image forming means, for feeding the sheet to said image forming means;

a second feeding means comprising, a first rotary member arranged at a downstream side of said image forming means for applying a feeding force to the sheet by contacting the sheet, a second rotary member for contacting a portion of the sheet where an image can be formed by said image forming means, said first rotary member and said second rotary member cooperating to pinch and feed the sheet, and a third rotary member for contacting a portion of the sheet where an image is not formed, said first rotary member and said third rotary member cooperating to pinch and feed the sheet; and a shifting means for shifting said second rotary member between a first position where the sheet is pinched between said second rotary member and said first rotary member, and a second position where the sheet is not pinched by said first rotary member and said second rotary member, while the sheet is pinched by said first rotary member and said third rotary member.

22. An image forming system according to claim 21, wherein said image forming means includes an ink jet head.

23. An image forming system according to claim 22, wherein said ink jet head forms the image with ink droplets by thermal energy.

24. An image forming system according to claim 21, further including operating means for operating said shifting means manually.

25. An image forming system according to claim 21, further including detecting means for detecting a material of the sheet and controlling means for controlling said shifting means in response to a result detected by said detecting means.

26. An image forming system according to claim 25, wherein said controlling means controls said shifting means so that said second rotary member is shifted to the second position when said detecting means detects a sheet of a material on which ink is relatively slow to dry.

27. An image forming system according to claim 26, wherein the sheet on which ink is relatively slow to dry includes an OHP sheet.

28. An image forming system according to claim 21, further including input means for inputting a material of the sheet, and controlling means for controlling said shifting means in response to the material of the sheet inputted by said input means.

29. An image forming apparatus, comprising:

image forming means provided with an ink jet head for forming an image on a sheet by ink droplets;

first convey means, arranged upstream of said image forming means, for conveying the sheet;

second convey means, arranged downstream of said image forming means, for conveying the sheet, said second convey means including a first member for contacting a surface of the sheet at an area where the image is formed by said image forming means and a second member for contacting the surface of the sheet at an area where the image is not formed by said image forming means; and separation means for separating said first member from the sheet while said second member remains in contact with the sheet, wherein said first member has a rotary member, and said second member has a second rotary member, and wherein said second convey means has a third rotary member cooperating with said first rotary member and said second rotary member to nip the sheet therebetween.

30. An image forming apparatus according to claim 29, wherein said separation means separates said first rotary member from the sheet.

31. An image forming apparatus according to claim 29, further comprising information output means for outputting sheet material information, and wherein said separation means separates said first member from the sheet based on the information outputted from said information output means.

32. An image forming apparatus according to claim 31, further comprising input means for inputting sheet material information to said information output means.

33. An image forming apparatus according to claim 29, wherein said second convey means applies a tension force to the sheet in a direction transverse to a conveying direction of the sheet.

34. An image forming apparatus according to claim 29, wherein said separation means separates said first member from the sheet in accordance with a sheet type.

35. An image forming system according to claim 29, wherein said second convey means has a third member that cooperates with said first member and said second member to nip the sheet between said third member and at least one of said first member and said second member.

36. An image forming system according to claim 29, further comprising information output means for outputting sheet material information, and wherein said separation means separates said first member from the sheet based on the sheet material information outputted from said information output means.

37. An image forming system according to claim 36, further comprising information input means for inputting sheet material information to said information output means.

38. An image forming system according to claim 29, wherein said second convey means applies a tension force to the sheet in a direction transverse to a conveying direction of the sheet.

39. An image forming system according to claim 29, wherein said separation means separates said first member from the sheet in accordance with a sheet type.

40. An image forming system according to claim 29, wherein said separation means separates said first member from the sheet by a manual operation.

41. An image forming system according to claim 29, wherein said separation means separates said first member from the sheet by a manual operation.

* * * * *

UNITED STATES PATENT AND TRADEMARK OFFICE

CERTIFICATE OF CORRECTION

PATENT NO. : 5,742,318
DATED : April 21, 1998
INVENTOR(S) : Yasuo MIYAUCHI, et al.

It is certified that error appears in the above-identified patent and that said Letters Patent is hereby corrected as shown below:

Column 2, line 37, delete "44" and insert therefor --49--;
Line 46, delete "41" and insert therefor --49--.

Column 5, line 55, delete "downstreamly" and insert therefor --downstream--;
Line 62, delete "repsect" and insert therefor --respect--.

Column 7, line 42, delete "fed" and insert therefor --feed--.

Column 9, line 47, delete "synchronous".

Column 12, line 5, delete "rollers" and insert therefor --rotary members--;
Line 32, delete "2" and insert therefor --1--;
Line 33, delete "roller".

Signed and Sealed this

Thirteenth Day of October 1998

*Attest:*

*Attesting Officer*

Bruce Lehman

BRUCE LEHMAN

*Commissioner of Patents and Trademarks*